US005131471A

United States Patent [19]

Duerksen et al.

[11] Patent Number: 5,131,471

[45] Date of Patent: * Jul. 21, 1992

[54] SINGLE WELL INJECTION AND PRODUCTION SYSTEM

[75] Inventors: John H. Duerksen, Fullerton; Donald J. Anderson, Costa Mesa, both of Calif.; Doug J. McCallum; Mark Petrick, both of Calgary, Canada

[73] Assignee: Chevron Research and Technology Company, San Francisco, Calif.

[ * ] Notice: The portion of the term of this patent subsequent to May 14, 2008 has been disclaimed.

[21] Appl. No.: 633,582

[22] Filed: Dec. 21, 1990

Related U.S. Application Data

[63] Continuation-in-part of Ser. No. 394,687, Aug. 16, 1989, Pat. No. 5,014,787, and a continuation-in-part of Ser. No. 555,327, Jul. 9, 1990, abandoned.

[30] Foreign Application Priority Data

Sep. 29, 1989 [CA] Canada ..... 615370

[51] Int. Cl.[5] ..... E21B 43/24; E21B 47/06

[52] U.S. Cl. ..... 166/303; 166/252; 166/306; 166/308; 166/313; 166/387

[58] Field of Search ..... 166/250, 252, 263, 272, 166/297, 298, 302, 303, 308, 313, 387, 306, 57, 62, 106, 191

[56] References Cited

U.S. PATENT DOCUMENTS

| | | | |
|---|---|---|---|
| 3,116,792 | 1/1964 | Purre | 166/258 X |
| 3,159,215 | 12/1964 | Meldau et al. | 166/258 |
| 3,182,722 | 5/1965 | Reed | 166/258 |
| 3,273,640 | 9/1966 | Huntington | 166/272 X |
| 3,361,202 | 1/1968 | Whipple | 166/306 X |
| 3,379,247 | 4/1968 | Santourian | 166/272 |
| 3,386,508 | 6/1968 | Bielstein et al. | 166/272 |
| 3,994,341 | 11/1976 | Anderson et al. | 166/303 X |
| 4,362,213 | 12/1982 | Tabor | 166/306 X |
| 4,485,871 | 12/1984 | Davis | 166/272 X |
| 4,488,598 | 12/1984 | Duerksen | 166/252 |
| 4,565,245 | 1/1986 | Mims et al. | 166/306 X |
| 4,595,057 | 6/1986 | Deming et al. | 166/303 X |
| 4,601,338 | 7/1986 | Prats et al. | 166/303 X |
| 4,828,031 | 5/1989 | Davis | 166/272 |
| 5,014,787 | 5/1991 | Duerksen | 166/313 X |
| 5,024,275 | 6/1991 | Anderson et al. | 166/303 |

*Primary Examiner*—George A. Suchfield

*Attorney, Agent, or Firm*—Edward J. Keeling; David J. Power

[57] ABSTRACT

A method is disclosed for fluid injection and oil production from a single wellbore which includes providing a path of communication between the injection and production zones.

11 Claims, 4 Drawing Sheets

SINGLE WELL INJECTION AND PRODUCTION SYSTEM

CROSS REFERENCE TO RELATED APPLICATIONS

This is a continuation-in-part of prior co-pending application Ser. No. 394,687, filed Aug. 16, 1989 now U.S. Pat. No. 5,014,787 and co-pending application Ser. No. 555,327, filed Jul. 9, 1990, now abandoned.

BACKGROUND OF THE INVENTION

This invention relates generally to the production of viscous hydrocarbons from subterranean hydrocarbon-containing formations. Deposits of highly viscous crude petroleum represent a major future resource in the United States in California and Utah, where estimated remaining in-place reserves of viscous or heavy oil are approximately 200 million barrels. Overwhelmingly, the largest deposits in the world are located in Alberta Province Canada, where the in-place reserves approach 1,000 billion barrels from depths of about 2,000 feet to surface outcroppings and at viscosities of up to 1 million c.p. at reservoir temperature. Until recently, the only method of commercially recovering such reserves was through surface mining at the outcrop locations. It has been estimated that more than 90% of the total reserves are not recoverable through surface mining operations. Various attempts at alternative, in-situ methods, have been made, all of which have used a form of thermal steam injection. Most pilot projects have established some form of communication within the formation between the injection well and the production well. Controlled communication between the injector and producer wells is critical to the overall success of the recovery process because in the absence of control, injected steam will tend to override the oil-bearing formation in an effort to reach the lower pressure area in the vicinity of the production well. The result of steam override or breakthrough in the formation is the inability to heat the bulk of the oil within the formation, thereby leaving it in place. Well-to-well communication has been established in some instances by inducing a pancake fracture. However, often problems arise from the healing of the fracture, both from formation forces and the cooling of mobilized oil as it flows through a fracture towards the producer. At shallower depths, hydraulic fracturing is not viable due to lack of sufficient overburden. Even in the case where some amount of controlled communication is established, the production response is often unacceptably slow.

U.S. Pat. No. 4,037,658 to Anderson, specifically incorporated herein by reference, teaches a method of assisting the recovery of viscous petroleum, such as from tar sands, by utilizing a controlled flow of hot fluid in a flow path within the formation but out of direct contact with the viscous petroleum; thus a solid-wall, hollow tubular member in the formation is used for conducting hot fluid to reduce the viscosity of the petroleum to develop a potential passage in the formation outside the tubular member into which a fluid is injected to promote movement of the petroleum to a production position.

The method and apparatus disclosed by the Anderson patent and related applications is effective in establishing and maintaining communication within the producing formation, and has been termed the Heated Annulus Steam Drive, or "HASDrive", method. In the practice of HASDrive, a hole is formed through the petroleum-containing formation and a solid wall hollow tubular member is inserted into the hole to provide a continuous, uninterrupted flow path through the formation. A hot fluid is flowed through the interior of the tubular member out of contact with the formation to heat viscous petroleum in the formation outside the tubular member thereby reducing the viscosity of at least a portion of the petroleum adjacent the outside of the tubular member, creating a potential passage for fluid flow through the formation adjacent the outside of the tubular member. A drive fluid is then injected into the formation through the passage to promote movement of the petroleum for recovery from the formation.

U.S. Pat. No. 4,565,245 to Mims describes a well completion for a generally horizontal well in a heavy oil or tar sand formation. The apparatus disclosed by Mims includes a well liner, a single string of tubing, and an inflatable packer which forms an impervious barrier and is located in the annulus between the single string of tubing and the well liner. A thermal drive fluid is injected down the annulus and into the formation near the packer. Produced fluids enter the well liner behind the inflatable packer and are conducted up the single string of tubing to the wellhead. The method contemplated by the Mims patent requires the hot stimulating fluid be flowed into the well annular zone formed between the single string of tubing and the casing. However, such concentric injection of thermal fluid, where the thermal fluid is steam, could ultimately be unsatisfactory due to scale build up in the tubing or the annulus. This scale comprises a deposition of solids such as sodium carbonate and sodium chloride, normally carried in the liquid phase of the steam as dissolved solids, which are deposited as a result of heat exchange between the fluid in the tubing and the fluid in the annulus. Parallel tubing strings, as disclosed in U.S. Pat. No. 4,595,057 to Deming, is a configuration in which at least two tubing strings are placed parallel in the well bore casing. The use of parallel tubing has been found to be superior in minimizing the scaling and heat loss suffered by prior injection methods during thermal well operations.

SUMMARY OF THE INVENTION

Accordingly, the present invention involves a method of achieving an improved heavy oil recovery from a heavy oil containing formation by utilizing a multiple tubing string completion in a single wellbore, said wellbore serving to convey both injection fluids to the formation and produced fluids from the formation. The injection and production would optimally occur simultaneously, in contrast to prior cyclic steaming methods which alternated steam and production from a single wellbore.

In the present invention a single string packer is positioned and set at a lower interval within a cased wellbore, establishing as a production zone that portion of the formation subjacent to the single string packer. A dual string is then set within the wellbore at a sufficient distance above the single string packer to traverse the completion interval, the distance between the single string and dual string packer, thereby defining a thermal zone. Perforations are placed subjacent to the packers to establish communication between the adjacent formation and the wellbore interior. A first tubing string is introduced into the wellbore, terminating in the production zone. The first tubing string is paralleled by a second tubing string, both first and second tubing strings being physically separated, with the second tubing string terminating superior to the single string packer, lying at the base of the thermal zone. A heated fluid is injected down the second tubing string, heating the interior of the wellbore as it travels from the terminus of the second tubing string through the injection perforations subjacent to the dual string packer. The heating by the injection fluid of the wellbore casing in turn facilitates convection heating of the formation adjacent to the wellbore, thereby creating a thermal conduit between the injection perforations and the production perforations subjacent to the single string packer. As the heated fluid is injected down the second tubing string, produced fluids from the formation are contemporaneously directed up the first tubing string as they traverse the thermal conduit to the production zone.

To realize the advantages of this invention, it is not necessary the wellbore be substantially horizontal relative to the surface, but may be at any orientation within the formation. By forming a fluid barrier within the wellbore between the terminus of the injection tubing string and the terminus of the production tubing string; and exhausting the injected fluid near the barrier while injection perforations are at a greater distance along the wellbore from the barrier, a wellbore casing is effective in mobilizing the heavy oil in the formation nearest the casing by convection heat transfer, thereby establishing the thermal communication path along the formation adjacent to the wellbore.

The improved heavy oil production method disclosed herein is thus effective in establishing communication between the injection zone and production zone through the ability of the wellbore casing to conduct heat from the interior of the wellbore to the heavy oil in the formation near the wellbore. At least a portion of the heavy oil in the formation near the wellbore casing would be heated, its viscosity lowered and thus have a greater tendency to flow. The single well method and apparatus of the present invention in operation, therefore, accomplishes the substantial purpose of an injection well, a production well, and a means of establishing communication therebetween. A heavy oil reservoir may therefore be more effectively produced by employing the method and apparatus of the present invention in a plurality of wells, each wellbore having therein a means for continuous thermal drive fluid injection simultaneous with continuous produced fluid production and multiple tubing strings. As a result of utilizing the method of the present invention a shorter induction period is achieved, usually a few days versus upward of the several weeks or more required in developing communication between a separate injection and production well. Additionally, the distance between the injection point of injected fluid into the hydrocarbon-containing formation and the production point of produced fluids is distinctly defined in the present method, whereas the spacing between a separate injection and production well is less certain. Through the distinct feature of the wellbore casing conducting heat into at least a portion of the oil in the formation outside of the casing, there is less pressure and temperature drop between injection and production intervals; therefore production to the surface of produced fluids, which retain more formation energy, is more likely accomplished with the present invention over previous separate well technology. Additionally, in producing fluids to the surface of the formation, the production tubing temperature loss is significantly reduced through its location within the wellbore casing along with the injection tubing string; therefore, bitumen and heavy oil in the produced fluids are less likely to become immobile and inhibit flow to the surface.

The present invention, in practice along with conventional equipment of the type well known to persons experienced in heavy oil production, and the generation of thermal fluids for injection and treatment of the resulting produced fluids, presents along with the present invention, a comprehensive system for recovery of highly viscous crude oil.

DESCRIPTION OF THE PREFERRED EMBODIMENTS

Figure 1:
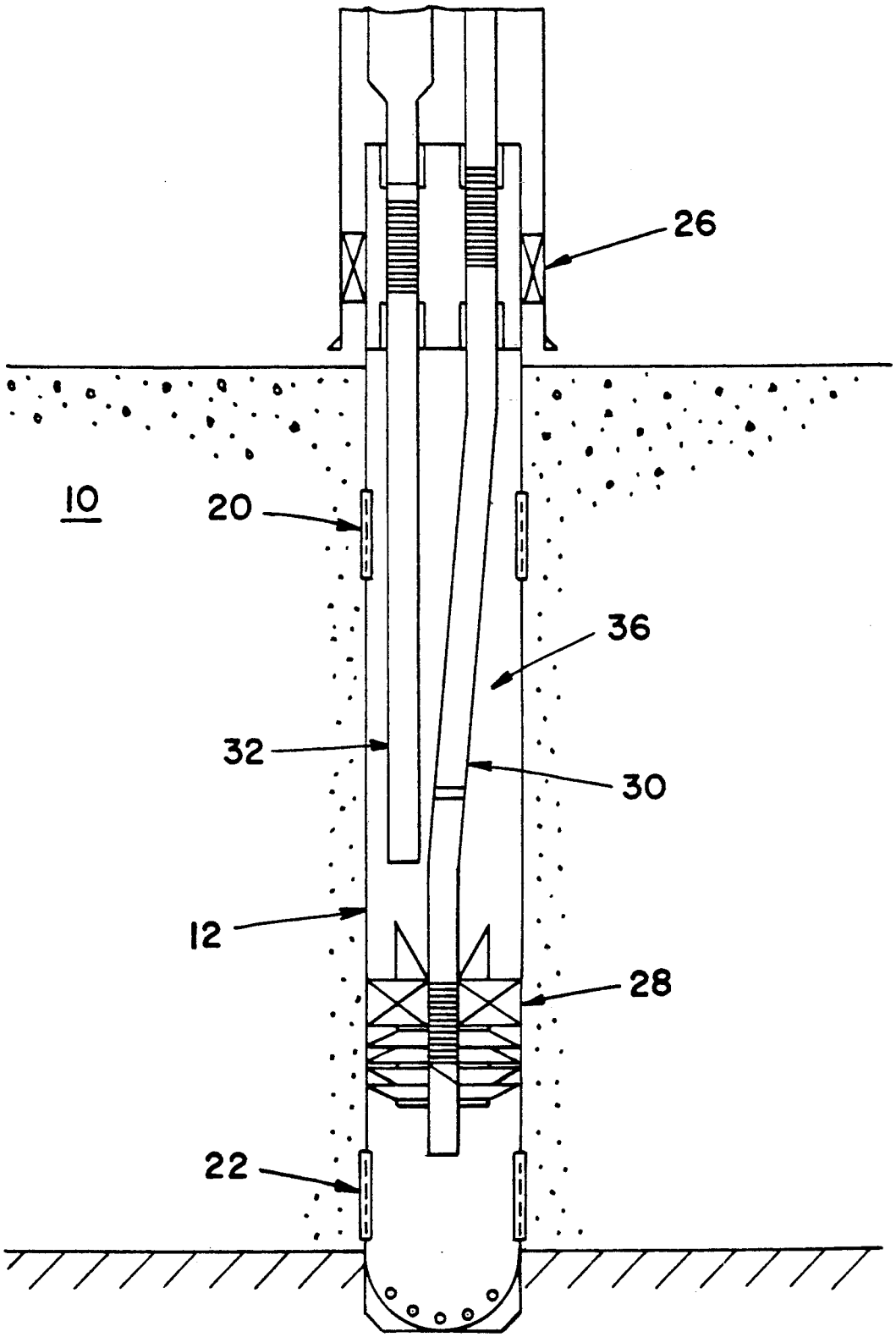
FIG. 1 is an elevation view in cross section of the single well injector and producer contemplated.

In the exemplary apparatus for practicing the present invention, as depicted by FIG. 1, a subterranean earth formation 10 is penetrated by a wellbore having a casing 12. Injection perforations 20 and production perforations 22 provide fluid communication from the wellbore interior to the earth formation 10. A dual string packer 26 and a single string packer 28 are placed above the injection perforations 20 and production perforations 22 respectively. The distance traversed by the wellbore between single string packer 28 and dual string packer 26 establishes a thermal operation zone; while the area subjacent to single string packer 28 constitutes a production zone. This distance is dictated by the size of the completion interval, which must be of sufficient size to avoid excessive pressure drop between the formation and the wellbore.

A first tubing string 30 and a second tubing string 32 are placed within the wellbore casing 12, both tubing strings extending through duel string packer 26, with second tubing string 32 terminating at a depth shallower in the wellbore than single string packer 28. An annular-like injection fluid flow path 36 is created by the space bounded by the dual string packer 26, single string packer 28, and the interior of wellbore casing 12. First tubing string 30 further extends through single string packer 28, terminating at a depth below said packer.

In one embodiment of the present invention, second tubing string 32 is supplied with pressured injection fluid from an injection fluid supply force (not shown). Injection fluid flows down second tubing string 32, exhausting from the terminus of the tubing string into the annular-like injection fluid flow path 36. Continual supply of high pressure injection fluid to the second tubing string 32 forces the injection fluid upward in the annular flow path 36, toward the relatively lower pressure earth formation 10, through injection perforations 20. While any standard industry injection fluid, such as hot water, may be used, in the preferred embodiment of the present invention the injection fluid is steam. When steam flows up the annular flow path 36 bounded by casing 12, thermal energy is conducted through the wellbore casing 12, and heating at least a portion of the earth formation 10 near the wellbore.

Hydrocarbon containing fluid located within the earth formation 10 near the wellbore casing, having now an elevated temperature and thus a lower viscosity over that naturally occurring in situ, will tend to flow along the heated flow path exterior of the casing 12. This heated flow path acts as a thermal conduit formed near the wellbore casing 12 by heat conducted from steam flow in the annular-like flow path 36 on the interior of the casing 12, toward the relatively lower pressure region near production produced fluids comprising hydrocarbons and water including condensed steam enters from the earth formation 10 through production perforations 22 to the interior of the wellbore casing 12 below single string packer 28. Produced fluids are continuously flowed into first tubing string 30 and up the tubing string to surface facilitates (not shown) for separation and further processing.

Figure 2:
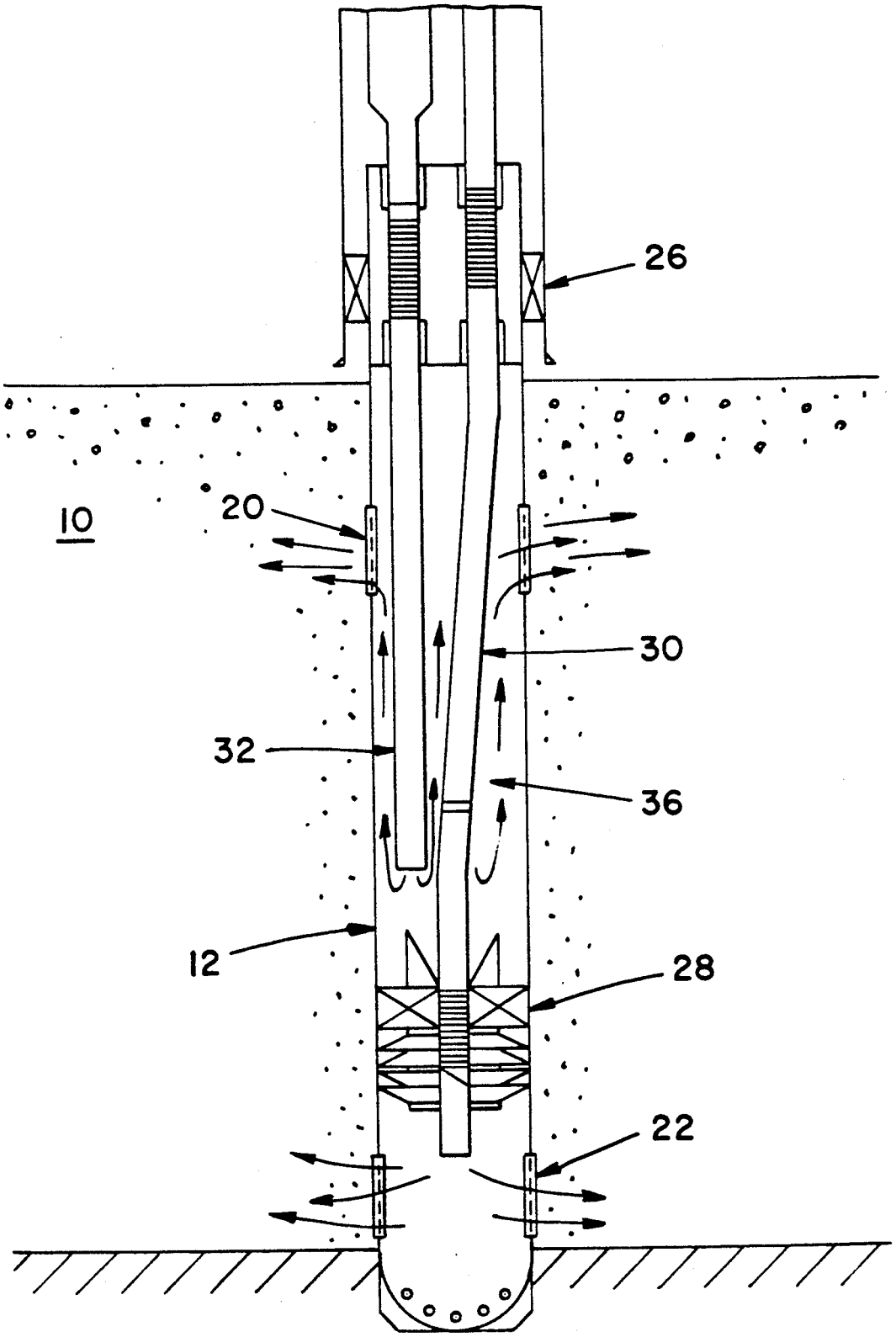
FIG. 2 is an elevation view in cross section of the single well injection and production system in the initiation configuration, whereby fluid is injected through multiple tubing strings.

In an alternative embodiment of the present invention, as depicted in FIG. 2, a means of achieving the advantageous result of quickly developing communication between the portion of the formation receiving injection fluid and that portion from which hydrocarbons are directed into the first tubing string 30, is to flow hot injection fluid into both first tubing string 30 and second tubing string 32, thereby pressuring the injection fluid into the formation through both injection and production perforations 20 and 22 respectively.

Referring to FIG. 2, in a preferred method of establishing this rapid communication between the portion of the subterranean earth formation subjected to injection fluid, and the lower portion from which fluids will be produced, steam from an injection fluid supply source (not shown) is flowed from the surface down both the first tubing string 30 and the second tubing string 32. Injection fluid in the second tubing string 32 flows from the terminus of second tubing string 32 along the annular-like flow path 36, exhausting from the wellbore into the hydrocarbon-bearing formation through injection perforations 20. For at least a portion of the time during which injection fluid is flowed into first tubing string 30, injection fluid is also flowed into second tubing string 32 from a surface injection fluid supply source (not shown). During this time, injection fluid in the first tubing string 30 is exhausted at the tubing tail and enters the hydrocarbon-bearing formation through casing perforations 22. Steam injection is continued down both tubing strings until injection rates drop below the values required to overcome heat loss in the surface lines and wellbore.

Figure 3:
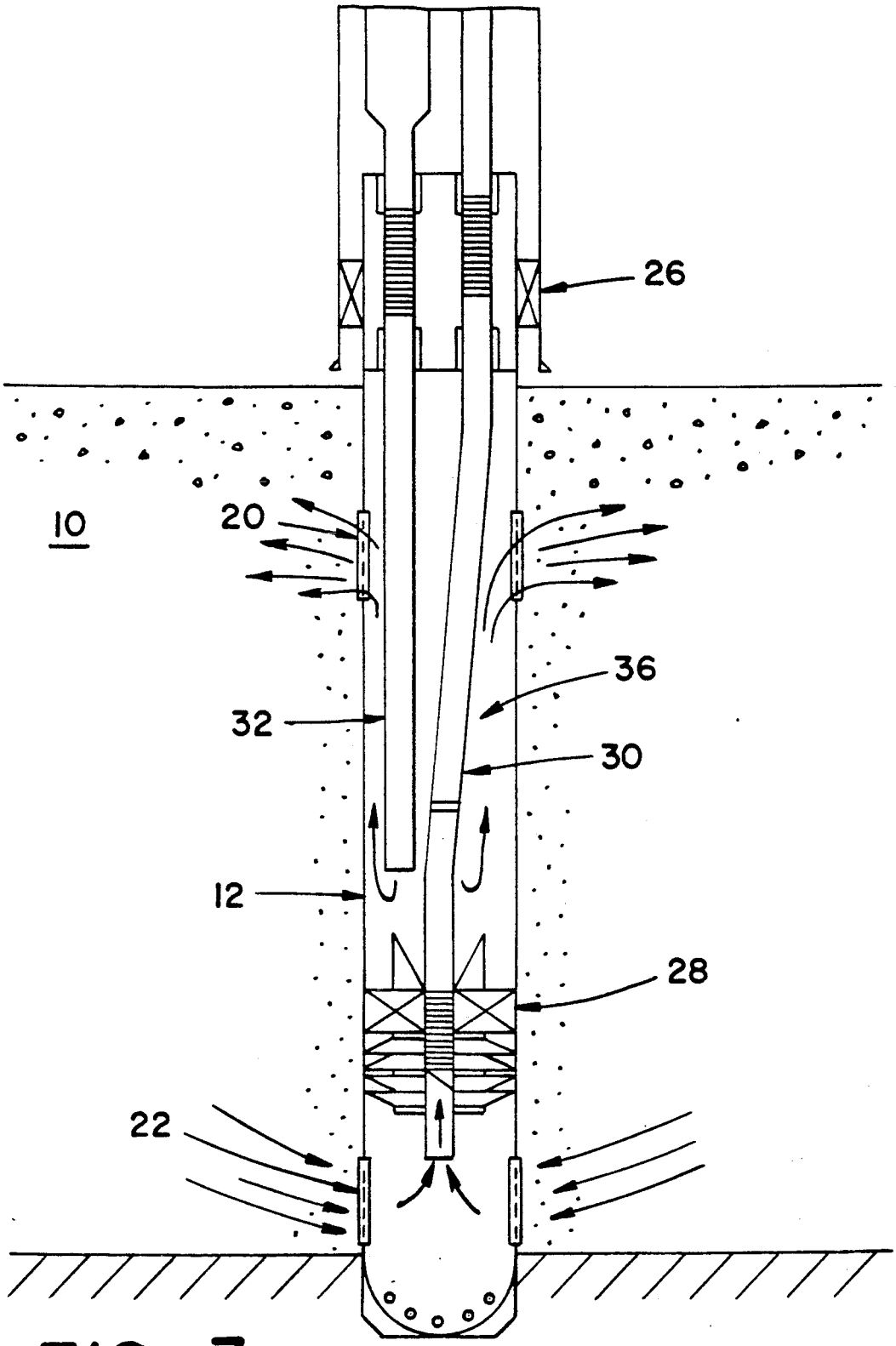
FIG. 3 is an elevation view in cross section of the single well injection and production system in the normal operational mode.

Referring now to FIG. 3, when sufficient injection fluid has entered the hydrocarbon-bearing formation to overcome said heat losses and reduce the viscosity of at least a portion of the reservoir fluid sought to be produced, and sufficient energy exists in the formation, the first tubing string 30 is disconnected from the injection fluid supply source (not shown), and fluid communication is established between the first tubing string 30 and production facilities (not shown). Due to a decreased pressure now existing in the first tubing string 30 relative to the pressure within the hydrocarbon-containing formation 10, formation fluid will tend to flow along the established thermal conduit from the hydrocarbon-containing formation 10 toward the terminus of first tubing string 30 through production perforations 22. It is preferred to minimize the duration of time between cessation of injection fluid flow through first tubing string 30 and the flowing of formation fluids in a reverse direction through first tubing string 30, in order to minimize the loss of thermal energy and thus minimize the flowing viscosity of the fluids produced from hydrocarbon-containing formation 10. This time interval is determined by monitoring the production rate values for any decrease, thereby signaling a lack of sufficient communication.

Figure 4:
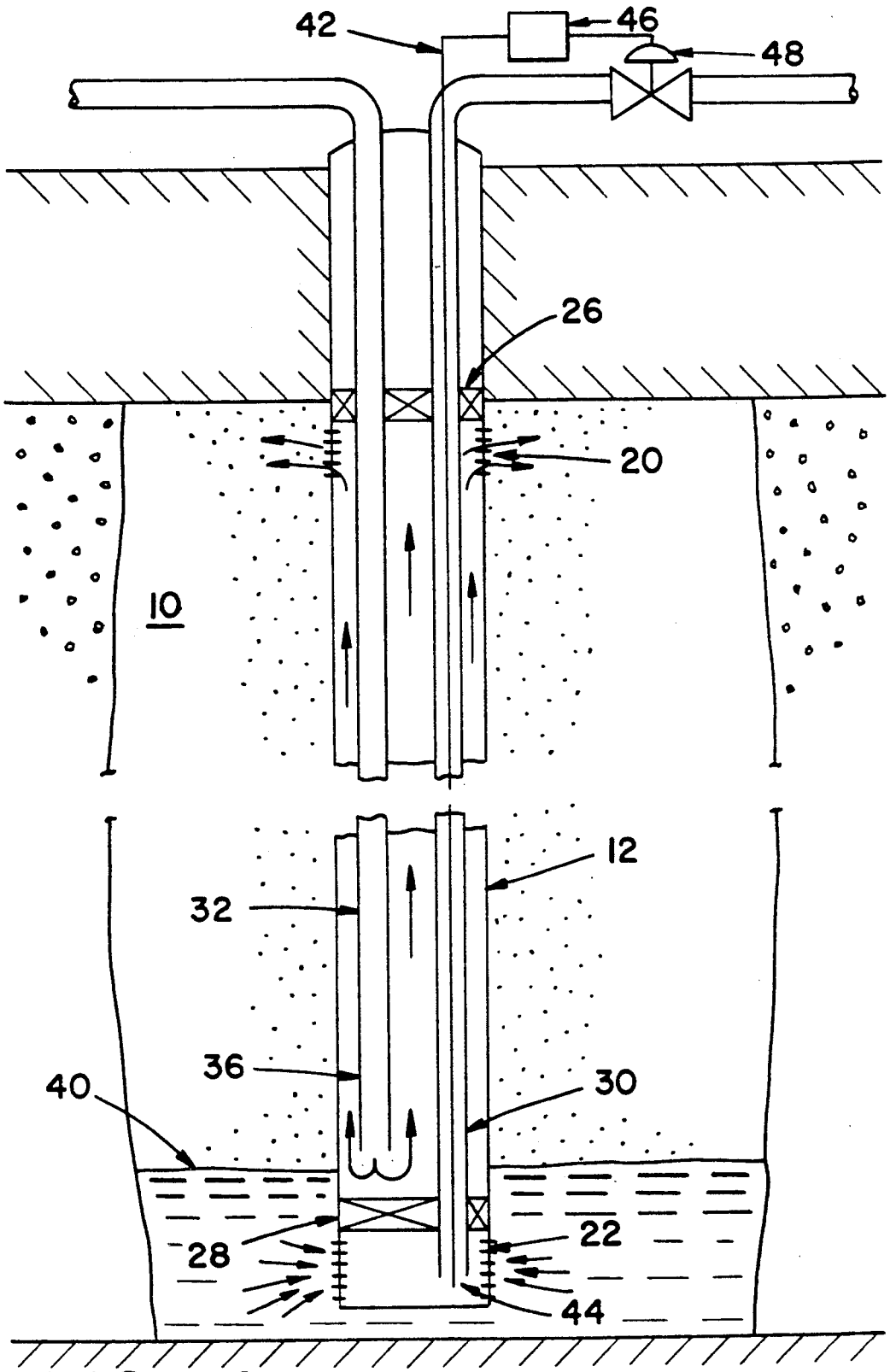
FIG. 4 is an elevation view in cross section of the single well injection and production system with control means during normal operation.

Referring now to FIG. 4, to avoid the entry of uncondensed steam into the gravel pack or wire mesh sand screen area located exterior of the wellbore near production perforations 22, a level of formation fluid interface 40, at a sufficient distance in the hydrocarbon-bearing formation above production perforations 22, is created and maintained. The level of interface 40 above production perforations 22 is directly proportional to the difference in pressure between the injection fluid in second tubing string 32 and pressure at the bottom hole fluid inlet to first tubing string 30. It is therefore possible to sense the pressure existing in first tubing string 30, compare it to the injection fluid pressure existing in second tubing string 32, or any point along the injection fluid flow path as defined by the injection fluid supply source and the terminus of the second tubing string 32, and determine the level of the formation fluid interface 40 above production perforations 22 based on the difference therebetween. In one embodiment, bottom hole pressure in the first tubing string 30 is sensed utilizing a well-known "bubble-tube" or "capillary tube" device. This capillary tube comprises a length of small diameter metallic tubing 42 which is extended from the surface to the downhole environment. The pressure existing at the downhole terminus of the small diameter metallic tubing 44 is transmitted via a gas, typically an inert gas such as nitrogen, to instrumentation 46 placed at the surface. Based upon the indicated pressure, an estimate of the height of fluid level interface 40 above the terminus 44 is used to control the degree of fluid restriction applied to the produced fluid stream in first tubing string 30 through incorporation of a surface control valve 48. Thus, the liquid level interface 40 is proportional to the difference in pressure ($\Delta P_1$) between Steam Injection Pressure (SIP), and Bottomhole Pressure (BHP), and is represented by the equation:

$$\Delta P_1 = BHP - SIP$$

By the method of the present invention, fluid interface is maintained at sufficient level above production perforations 22 to form a liquid seal at the fluid entrance to the wellbore, thereby avoiding the contact of uncondensed injection fluid with the gravel pack, wire mesh sand screen or other well completion device which may be subject to damage from contact with hot or high velocity injection fluid.

In still a further embodiment of the present invention, wherein production from diatomites can be achieved, the quick establishment of a thermal communication path, as previously described, is initiated by injecting the injection fluid, preferably steam, above fracture pressure. In the preferred embodiment, the fractures from the production zone to the injection zone connect together to make one continuous fracture system. The initial injection of steam, or other drive fluid, above fracture pressures forces the fractures open to facilitate imbition and gravity drainage to the production zone.

After injection down the first tubing string 30 has terminated, and production of fluids through production perforations 22 and into first tubing string 30 has been initiated, the continuous injection of fluids through second tubing string 32 at above fracture pressure prevents partial healing of the fractures as is common in cyclic steaming operations.

For each of the embodiments herein described, in order to increase the portion of the subterranean formations from which viscous hydrocarbons are produced, it may be advantageous to relocate the upper dual-string packer such that the distance between the packers in the wellbore is increased. In this manner, steam or other drive fluid flows from the interior of the wellbore through newly created perforations, above previously the sole injection perforations 20. As before, the passage of the steam or other hot drive fluid from the terminus of the second tubing string through the annular-like flow path to the injection perforations conducts heat through the casing wall to heat and thus make more mobile at least a portion of the viscous hydrocarbons in the formation near the wellbore. Further, it may be advantageous, particularly in very thick hydrocarbon containing formations, to relocate both the injection and production perforations, in order to recover increasing amounts of hydrocarbons from the formation. By relocating the single string packer lower in the wellbore, superior to the new production perforations, and relocating the dual-string packer to a point superior to either the previous production perforations, or, alternately new injection perforations, the location of a new zone of operation is accomplished.

Due to continuous injection fluid entering the formation from the wellbore in the zone of operation, an elevated pressure is maintained within the formation over that pressure naturally occurring, and above that existing in the production zone portion of the wellbore apparatus below the lower or single-string packer. Further, due to increased mobility and lowered viscosity of the viscous hydrocarbons in the formation it will be possible, at least in shallower wells, (less that 2000 ft.), to flow produced fluids from the production zone to the surface for ultimate recovery by maintaining a bottom hole pressure in the production zone which is sufficient to accomplish the flow of produced fluid without the aid of a pump. Back-pressure is maintained, thereby maintaining a liquid level in the formation in the production zone by regulating the flow of produced fluids within the first tubing string. In one embodiment, produced fluid flow is regulated based upon the temperature of the produced fluid sensed at or near the wellhead. A valve or other flow regulator device is adjusted to maintain a predetermined "set-point" temperature in the produced fluids. If the temperature is less than the predetermined set-point, the valve or other regulator means is manipulated to adjust flow. In some cases, significant heat transfer between the first and the second tubing strings in the wellbore may occur. The direction or valve operation and degree of flow regulation necessary to achieve a predetermined set-point temperature often varies from well to well, and thus the above described flow control scheme would be determined on an individual well-to-well basis. In order to minimize the effect of heat transfer between the separate strings of tubing in the wellbore, in the practice of the present invention it is desirable to provide a thermally insulated section of tubing between the upper and lower packers where heat transfer potential is more prevalent. However in one preferred embodiment of the present invention, steam is exhausted from the tail of the second tubing string and travels in the annular-like section in direct contact with the first tubing string, thereby heating the lower temperature produced fluids therein to enhance recovery of said fluids to the surface.

Although the present invention has been described with preferred embodiments, it is to be understood that modifications and variations may be resorted to without departing from the spirit and scope of the present invention, as those skilled in the art will readily understand. Such modifications and variations are considered to be within the purview and scope of the appended claims.

What is claimed is:

1. A method for producing viscous hydrocarbons from a subterranean formation, comprising the steps of:

(a) drilling and casing a wellbore which traverses the formation;

(b) perforating both an upper and a lower portion of said casing to establish communication between the wellbore and the formation adjacent to said perforations, said upper perforations constituting injection perforations, said lower perforations constituting production perforations;

(c) setting a first packer at a point above said upper perforations and a second packer at a point above said lower perforations to establish a thermal zone between said first and second packer and a production zone below said second packer;

(d) introducing a first tubing string into the wellbore and terminating said first tubing string at the production zone;

(e) introducing a second tubing string into the wellbore, said second tubing paralleling the first tubing string and terminating in a lower interval of the thermal zone;

(f) injecting a drive fluid into the second tubing string, said drive fluid exiting said second string and entering the thermal zone to transfer heat to said formation adjacent to said thermal zone establishing a thermal communication path within said formation, said drive fluid exiting the injection perforations to further heat the formation, making more mobile at least a portion of the viscous hydrocarbons located within the formation between the terminus of said second string and said injection perforations;

(g) simultaneously flowing a produced fluid from the production zone through the first tubing string while injecting said drive fluid into said second tubing string, said produced fluid comprising a mobilized portion of said viscous hydrocarbons.

2. The method according to claim 1 wherein the second tubing string is terminated at a lower most portion of the thermal zone maximizing the physical distance between an exhaust port at the terminus of said second string and said injection perforations.

3. The method according to claim 2 wherein the flow of produced fluids from the production zone requires no artificial lift means, said flow accomplished by a sufficient bottomhole pressure to force said fluids up said wellbore to the surface.

4. The method according to claim 1 wherein the drive fluid is steam.

5. The method according to claim 1 wherein the drive fluid is hot water.

6. The method according to claim 1 further comprising the step of insulating the second tubing string between said first and second packer to minimize heat transfer between fluid in said first tubing string and fluid in the second tubing string.

7. The method according to claim 1 further comprising the step of quickly developing said thermal communication path and initiating fracturing of the adjacent formation by initially injecting said drive fluid down both the first and second tubing strings at above fracture pressure to heat and establish a continuous fracture system in both the thermal zone and the production zone, said flow within the first tubing string reversed after sufficient heating and fracturing of the formation to produce fluids from the formation while sad second string prevents heating of the fracture system by continuing injection of said drive fluid at above fracture pressure.

8. The method of recovering viscous hydrocarbons in a subterranean formation from a single wellbore, comprising the steps of:

(a) providing a cased wellbore penetrating the formation;

(b) selecting a first one of operation within the wellbore;

(c) perforating the wellbore casing establishing injection perforations at an upper location and production perforations at a lower location, said upper and lower locations further defining respectively an injection zone and a production zone within said zone of operation;

(d) setting a single string packer at a point just above the production perforations;

(e) setting a dual string packer at a point just above the injection perforations, said dual string packer and said single string packer cooperating to define the area therebetween as an upper and a lower boundary of the zone of operation;

(f) introducing both a steam tubing string and a production tubing string into the wellbore, said steam tubing string halving its terminus at a lower most portion of the zone of operation, said production string having its terminus in the production zone below said single string packer;

(g) flowing steam from the terminus of said steam tubing along the interior of the wellbore casing to the injection perforations, said flow steam conducting heat through the casing to the adjacent formation and establishing a thermal communication path before exiting through said injection perforations into said formation;

(h) flowing produced fluids from the formation into the production tubing simultaneous with said flow steam to said formation; and (i) selecting a second zone of operation within the wellbore and repeating steps c through h, said second zone being defined by relocating said single and dual string packers within the wellbore, said first and second zones of operation thereby defining a hydrocarbon bearing region within the subterranean formation.

9. The method according to claim 2 wherein the physical distance between an exhaust port at the terminus of the steam tubing string and the injection perforations is maximized.

10. The method according to claim 8 wherein the flow of produced fluids from the production zone requires no artificial lift means, said flow accomplished by a sufficient bottom hole pressure to force said fluids up the wellbore to the surface.

11. The method according to claim 8 further comprising the step of quickly developing the thermal communication path and initiating fracturing of the adjacent formation by initially injection said steam down both the stress tubing string and production tubing string at above fracture pressure to heat and establish a continuous fracture system in both the thermal zone and the production zone, said steam flow within the production tubing string halted after sufficient heating and fracturing of the formation and said production tubing converted to produce fluids from the formation while said steam tubing prevents healing of the fracture system by continuing injection of said steam at above fracture pressure.

* * * * *

UNITED STATES PATENT AND TRADEMARK OFFICE

CERTIFICATE OF CORRECTION

PATENT NO. : 5,131,471

DATED : July 21, 1992

INVENTOR(S) : Duerksen et al.

It is certified that error appears in the above-indentified patent and that said Letters Patent is hereby corrected as shown below:

| | |
|---|---|
| Claim 7, Col. 9, line 14 | "while sad second" should read --while said second-- |
| Claim 7, Col. 9, line 15 | "prevents heating of" should read --prevents healing of-- |
| Claim 8, Col. 9, line 24 | "selecting a first one" should read --selecting a first zone-- |
| Claim 8, Col. 9, line 42 | "string halving its" should read --string having its-- |
| Claim 10, Col. 10, line 27 | "bottom hole" should read --bottomhole-- |
| Claim 11, Col. 10, line 33 | "both the stress tubing" should read --both the steam tubing-- |

Signed and Sealed this

Fourth Day of October, 1994

Bruce Lehman

*Attest:*

BRUCE LEHMAN

*Attesting Officer*

*Commissioner of Patents and Trademarks*